United States Patent [19]

Sagara et al.

[11] Patent Number: 4,614,144

[45] Date of Patent: Sep. 30, 1986

[54] MUSIC CARD SYSTEM

[75] Inventors: Iwao Sagara; Koichi Nakagawa; Shintaro Hotta, all of Tokyo, Japan

[73] Assignee: Oki Electric Industry Co., Ltd., Tokyo, Japan

[21] Appl. No.: 653,445

[22] Filed: Sep. 21, 1984

[30] Foreign Application Priority Data

Sep. 28, 1983 [JP] Japan ..... 58-178165

[51] Int. Cl.[4] ..... G10H 7/00

[52] U.S. Cl. ..... 84/1.28; 84/462; 84/483 R; 84/DIG. 1; 235/375; 235/492; 340/825.25

[58] Field of Search ..... 84/1.01, 1.03, 1.28, 84/478, 481, 483 R, 462, DIG. 1, DIG. 27; 235/375, 492; 340/825.25

[56] References Cited

U.S. PATENT DOCUMENTS 3,926,088 12/1975 Davis et al. ..... 84/462
4,347,405 8/1982 Davis ..... 84/DIG. 1
4,448,104 5/1984 Hoshii ..... 84/1.01
4,470,334 9/1984 Barlow et al. ..... 84/1.28

OTHER PUBLICATIONS

Stephen B. Weinstein, "Smart Credit Cards: The Answer to Cashless Shopping," *IEEE Spectrum,* Feb. 1984, pp. 43–49.

*Primary Examiner*—S. J. Witkowski
*Attorney, Agent, or Firm*—Martin Novack

[57] ABSTRACT

A plastic card mounting an IC memory of a credit card size called a music card stores encoded digital music information including tone, musical interval, musical length and loudness of each musical note and pause, and said music information actuates a synthesizer which generates music sound signal. The music card also stores a character code for indicating title of music on said synthesizer. As music note is encoded and stored in a digital form, a small capacity of IC memory is enough for storing a long play music.

10 Claims, 9 Drawing Figures

START

100
INSERTION OF A MUSIC CARD INTO A SYNTHESIZER
102
POWER SOURCE ON
104
DESIGNATING MUSIC TITLE
106
READING INITIAL CONDITION CODE
108
DESIGNATING MUSICAL INSTRUMENT, AND TEMPO
110
READING CHARACTER CODE
112
INDICATION OF MUSIC TITLE
114
READING MUSIC CODE
116
PLAYING MUSIC
118
FINDING END CODE
120
CONTINUE ?
YES
NO
STOP

MUSIC CARD SYSTEM

BACKGROUND OF THE INVENTION

The present invention relates to a music card system which stores music information for playing music.

Conventionally, a disc record, or a magnetic tape has been used for storing and playing music. Those means store music information which is in analog signal form on a record disc, or a magnetic tape. Those means have the advantage that they are portable, easy to handle, and everyone may enjoy music by using a record player, an amplifier, and a speaker. However, those means have the disadvantage that a record disc and/or a magnetic tape wears and the music quality or the tone quality deteriorates in the long run, because music is reproduced in those means through relative mechanical movement and friction between a storage means, and a reproducing means.

On the other hand, a music synthesizer has recently been developed. That synthesizer composes a tone of any music apparatus, like a flute, an oboe, a clarinet, and/or an organ through electronic process. A conventional music synthesizer has a keyboard for playing music, a music synthesizer circuit, an amplifier, and a speaker. However, a conventional music synthesizer has the disadvantage that it can not store music in a small portable storage means.

On the other hand, an IC card which has an integrated circuit memory is used as a credit card. However, no attempt has been made to use an IC card to store music information.

SUMMARY OF THE INVENTION

It is an object of the present invention to overcome the disadvantages and limitations of prior music recording systems, by providing a new and improved music recording/reproducing system.

It is also an object of the present invention to provide a music card system, in which a music card storing music information code in a semiconductor memory provides music sound through a music synthesizer.

The above and other objects are attained by a music card system comprising an integrated circuit card having a plastic support with an integrated circuit memory together with an integrated circuit micro-computer, said integrated circuit memory storing at least a control code designating a music instrument, a character code indicating a title of a musical piece, and digital music codes relating to the musical score of a musical piece, a music synthesizer for generating an electrical signal according to a digital code read out of said integrated circuit memory when said card is inserted into the synthesizer, said synthesizer having a visual indicator of a title of a musical piece according to said character code read out of said integrated circuit memory, and a keyboard for designating a desired musical piece in said memory for playing, and a speaker for converting said electrical signal to acoustic music sound.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1:
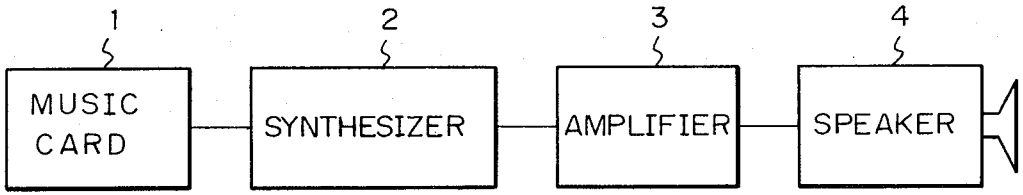
FIG. 1 is a block diagram of a music reproducing system using the present music card.

FIG. 1 shows a brief block diagram of a music reproduction system according to the present invention. A music card 1 has a semi-conductor memory which stores a music information code (like a musical note, a pause, etc.). The music card 1 has also a control circuit which reads out the content of the semi-conductor memory, and forwards the output to the music synthesizer 2. The music synthesizer 2 synthesizes music which has the designated tone (flute or organ etc.), the designated musical interval, the designated musical length and/or the designated loudness. The synthesizer 2 may be either a sine-wave combiner system, or a filter system. In the sine-wave combiner system, a plurality of sine-waves in a harmonic tone relationship are generated, and the combination of said sine-waves with the designated ratio provides the desired tone. In the filter system, a saw-tooth wave which includes many harmonics is generated as an acoustic source, and the output of the acoustic source is processed by a filter so that the desired tone is obtained. Those synthesizers may produce any desired music sound by properly designing the grade of harmonics, or the filters, and a tone of a flute, an oboe, a clarinet, an organ, a violin, a guitar, or a drum is possible to be synthesized. A synthesizer circuit itself may be that of a conventional electronic musical instrument which has a piano-type keyboard for playing (The Casiotone 403 is an example of one).

The music signal synthesized by the synthesizer 2 is applied to the amplifier 3, and then, to the speaker 4 which converts an electrical music signal to an acoustic music signal. The structure of the amplifier 3 and the speaker 4 is of course the same as that of conventional ones.

Figure 2:
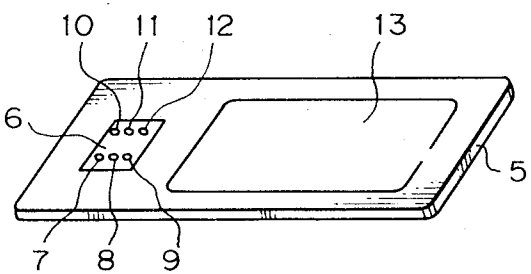
FIG. 2 is an external view of a music card according to the present invention.

FIG. 2 shows an external view of a music card according to the present invention. The size of the music card is for instance the same as a conventional credit card except for thickness. In a preferred embodiment, the size of the music card is 54 mm×86 mm, and the thickness of the card is 1.75 mm. The music card has a support plate 5 made of plastic as is the case for a credit card. A semiconductor device 6 and a label 13 are mounted on the support 5. The semiconductor device 6 has a semiconductor memory 15 and a control circuit 14 (see FIG. 3). The memory device 15 is for instance an electrical programmable read only memory (EPROM), which is written into an electrical signal and is erased by illuminating the same with an ultraviolet beam. The memory capacity of the ROM is for instance 64 kilo-bytes. The control circuit 14 is implemented in this embodiment by an 8-bit micro-computer which may be, for instance, model MSM80C48 or MSM80C49, both of these being an 8 bit micro-computer including a RAM, produced by OKI Electric Industry Co., Ltd., Tokyo, Japan. The terminals 7, 8, 9, 10, 11 and 12 are mounted on the support plate 5 for coupling the semiconductor device with an external circuit, and of course those terminals are coupled with the EPROM, and the 8-bit micro-computer.

The semiconductor device 6 is mounted on one surface of the plastic plate 5 by adhesive means, and the terminals 7 through 12 are mounted on the other surface of the plastic plate 5. The semiconductor device and the terminals are sealed by plastic. The terminal 7 is a power source terminal $V_{cc}$, the terminal 8 is an I/O terminal for an electrical information signal, the terminal 9 is a reset terminal for initiating the semiconductor circuit, the terminal 10 is a X'tal signal input terminal for accepting a clock signal for the operation of the semiconductor device, the terminal 11 is an EPROM write terminal, and the terminal 12 is a gound (GND) terminal.

Figure 3:
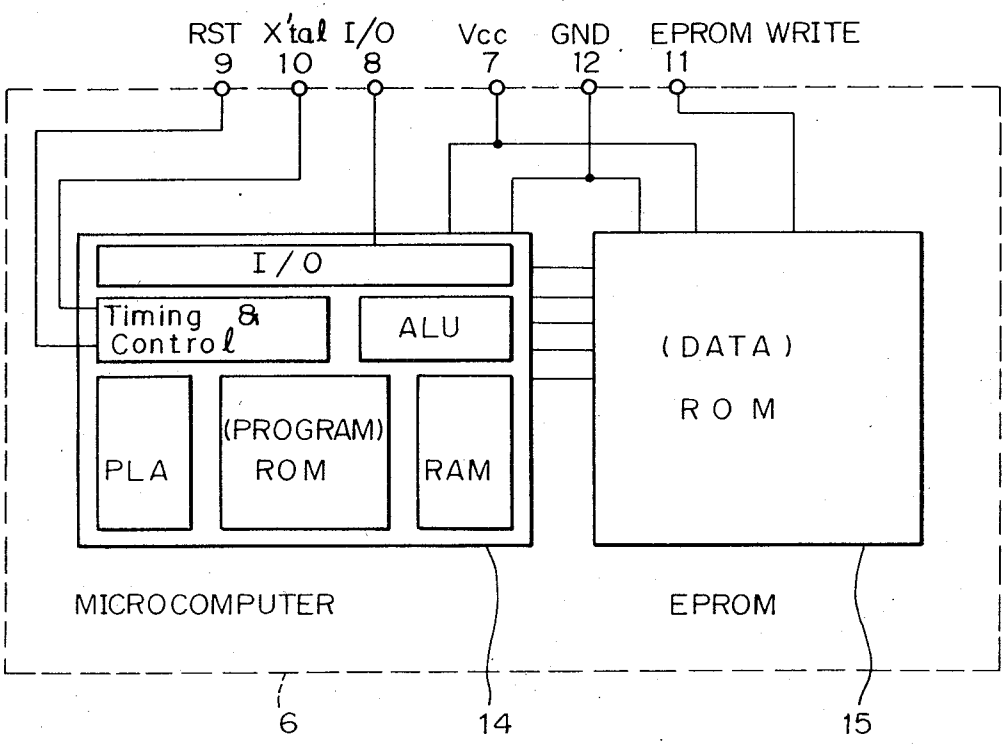
FIG. 3 is a circuit diagram of a semiconductor portion in a music card.

FIG. 3 shows a circuit diagram of the semiconductor device 6. The micro-computer chip 14 has an ALU (arithmetic control unit), a timing & control circuit, a PLA (programable logic array), a RAM (random access memory), a ROM (read only memory), and an I/O circuit. The ROM on the micro-computer chip 14 stores a program for the operation itself of the micro-computer 14. The terminals 9 (RST), and 10 (X'tal) are connected to the timing & control circuit. The I/O circuit processes an input data and an output data, and the output signal of the EPROM 15 is converted to a serial form so that a music data in a serial form is provided at the terminal 8 (I/O).

The semiconductor memory (EPROM) 15 has 64 kilo-bytes capacity for storing a code of music score, a character code for an indication purpose, and some control data. The micro-computer 14 and the EPROM 15 are coupled with an external power source through the terminals 7 ($V_{cc}$), and 12 (GND).

Figure 4:
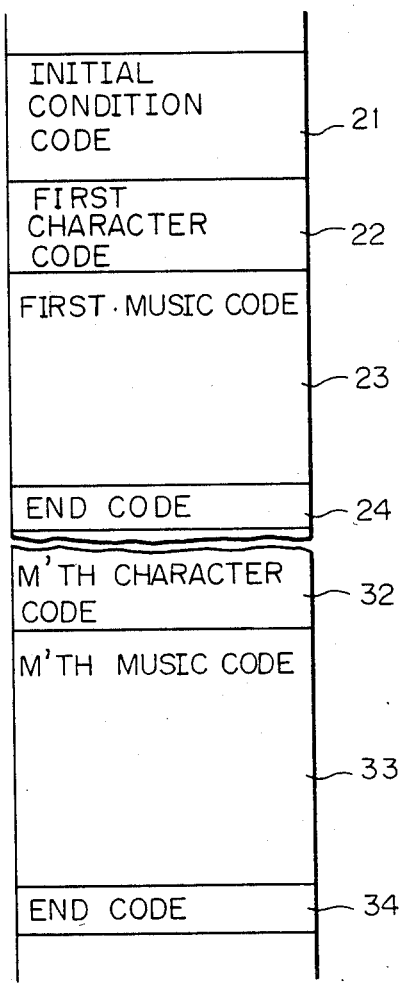
FIG. 4 shows a ROM map in a semiconductor memory in the music card according to the present invention.

FIG. 4 shows an example of a ROM map in the EPROM 15. The EPROM 15 stores the initial condition area 21 which has the information of a music program, a musical instrument code, and the playing tempo of music. The music program shows that the following music is the first music in the present card.

Following said initial condition area 21, the first character code 22 is stored. Said character code 22 stores the music title code, like "piano sonatina by Mozart". That character code 22 is indicated on a display 45 on a front panel of a music synthesizer (see FIG. 5) for visible display of a music title to be played.

Following said character code 22, a first music information code 23 is stored in the ROM map. The code 23 includes a musical interval, length, loudness, a pause et al, and that information is coded in a binary code. Each musical note is encoded by using 16 bits (6 bits for musical interval, 5 bits for length, 5 bits for loudness). Each pause is encoded by using 5 bits for indicating the time length of a pause. Therefore, a piano music of about 3 minutes may be encoded in 2 kilo-bytes memory. Of course, the necessary memory capacity depends upon each music program. Accordingly, it should be appreciated that a small capacity of memory is enough for storing a relatively long music program.

Assuming that a music information were encoded through a conventional analog process using a PCM (pulse code modulation), 64 kilo-bytes are necessary for recording one second of music when sampling rate is 32 kHz, and each sample is encoded to 16 bits. Thus, three minutes of music would occupy;

$$64\ (\text{kbytes}) \times 60\ (\text{seconds}) \times 3\ (\text{minutes}) = 11{,}520\ \text{kbytes}$$

Accordingly, it should be appreciated that the present recording system which stores only music notes saves much memory capacity. According to the present invention, 64 kbytes of ROM is enough for storing 90 minutes of music.

In FIG. 4, an end code 24 is provided after the first music. That end code indicates the end of a musical piece.

Following to the end code 24 for the first music, the initial condition area, the character code, the music information code, and the end code for the second music are provided. Similarly, the succeeding music to the m'th music is stored in the music card as shown in FIG. 4.

Figure 5:
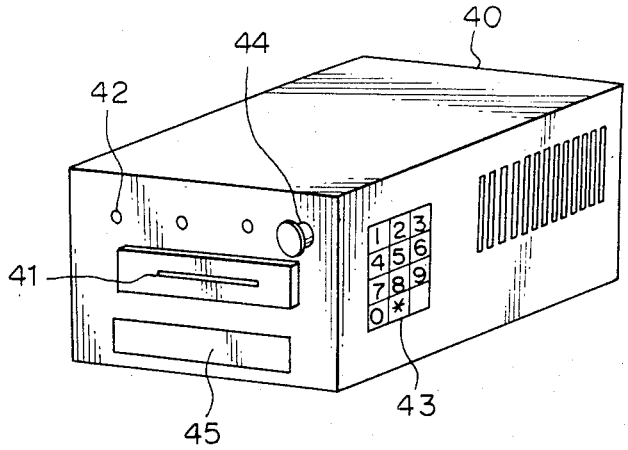
FIG. 5 is an external view of a music synthesizer according to the present invention.
Figure 8:
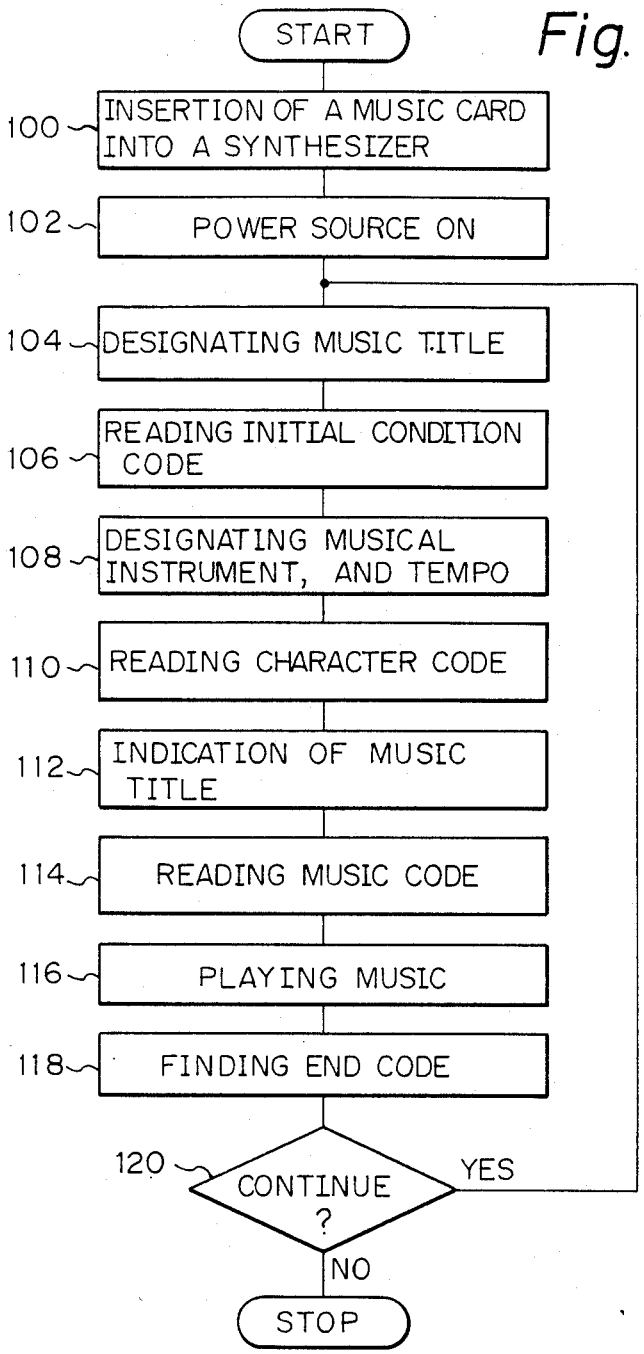
FIG. 8 is a flow diagram for reproduction of music through the present music card.

FIG. 5 shows an external view of the music synthesizer 40, in which 41 is an input opening for accepting a music card, and FIG. 8 shows the flow diagram for playing a synthesizer. Upon insertion of a music card in said opening 41 (100 in FIG. 8), the terminals 7 through 12 of the music card are coupled with the related contacts of the synthesizer, and a power source, and a clock pulse (X'tal) are supplied to the micro-computer 14 (102 in FIG. 8), and the EPROM 15, and then, the acknowledge lamp 42 goes ON. Then, an operator depresses a keyboard 43 to enter a desired music number code (104 in FIG. 8), then, the micro-computer 14 which operates according to the program in the ROM, controls the EPROM 15 so that the music designated by said keyboard is read. Thus, the musical instrument, the tempo, et al in the initial condition area of the designated music are provided to the synthesizer (106, 108 in FIG. 8). Then, the character code of the designated music is provided to the synthesizer and is indicated on the character indicator 45 (110, 112 in FIG. 8). Therefore, a person can recognize the music title which is now played on the indicator 45. Then, the person depresses the switch 44 to begin playing the designated music so that the music code on the card is provided to the synthesizer.

Then, a music note code in a music code is provided to the synthesizer (114 in FIG. 8). The music note code is comprised of 16 bits with 6 bits of musical interval code, 5 bits of length code, and 5 bits of loudness code. The synthesizer synthesizes the electrical signal according to said musical note code with the tone and the tempo designated by the initial condition area (116 in FIG. 8). The synthesized signal is applied to the speaker which provides a sound signal, through the amplifier. The synthesizer measures the time, and when the time designated by the music note code elapses, the next musical note code in the card is read out. Similarly, the musical note codes recorded in the music card are read out sequentially, and those codes synthesize a related electrical signal. When a pause code is read out, no sound is generated, and when the time designated by the pause code elapses, the next musical note code is read out of the music card.

When the end code 24 is read out, the reading operation of the music card finishes.

When an end code is read out, the synthesizer 40 and the micro-computer in the card are initiated for the next operation (118, 120 in FIG. 8).

Next, when the keyboard 43 is depressed, and the keybutton "3" is depressed, the third music in the card is read out. Thus, the third initial condition area is read out, then, the third character code is read out for the indication, and the third music code is read out for synthesizing a music sound. Similarly, a plurality of musical pieces can be played using a single music card. Of course, the sequence of playing music is arbitrary, and it should be noted that it takes very short time to begin the designated music, while a conventional tape recorder requires a long time to reach the beginning of the music because of slow running speed of a magnetic tape.

The operational flow diagram of synthesizing music according to the present invention is shown in FIG. 8.

Figure 6:
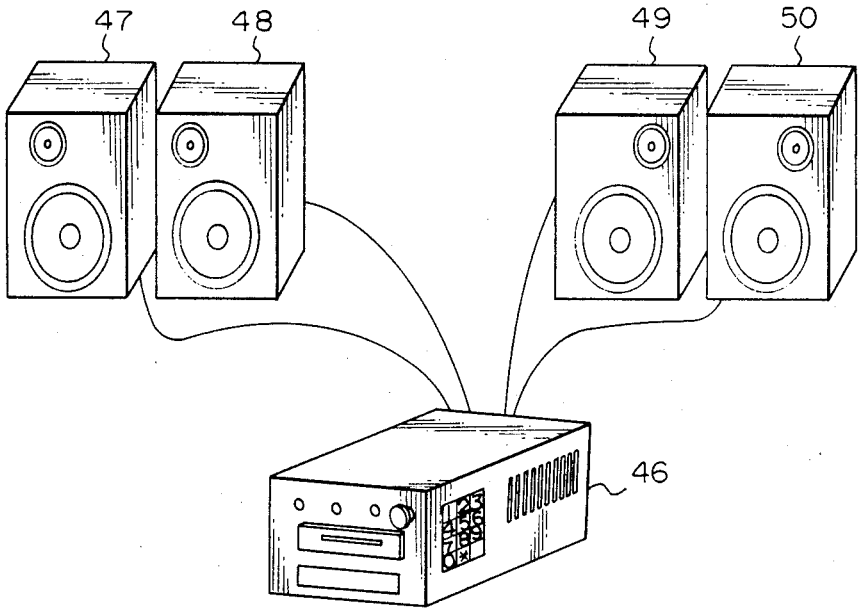
FIG. 6 is another external view of a music synthesizer for a quartet.

FIG. 6 shows another embodiment of the present invention, and shows the case of quartet. The reference numeral 46 is a music synthesizer which can synthesize four musics simultaneously, and is implemented, for instance, by combining four synthesizers 40 of FIG. 5. The numerals 47, 48, 49 and 50 are speakers each relating to each component of the synthesizer 46, therefore, each speaker plays each music instrument.

Figure 7:
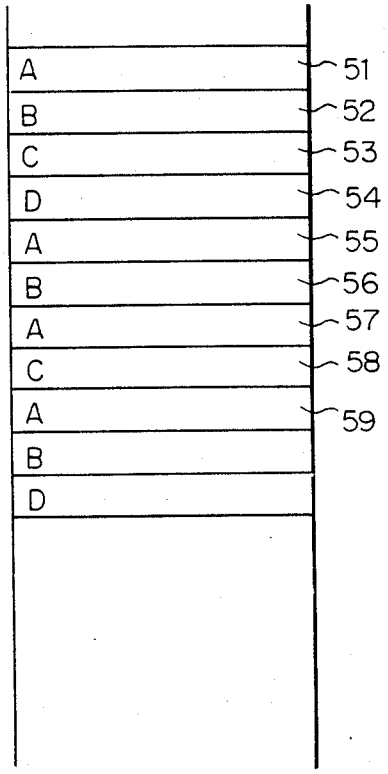
FIG. 7 is an example of a ROM map for a quartet.

FIG. 7 shows an example of an EPROM of a music card for a quartet, and shows only a part of a music code area. The numeral 51 shows a musical note code for a first musical instrument, for instance a flute, and comprises of 2 bits of musical instrument designation code, 6 bits of musical interval code, 5 bits of length code, and 5 bits of loudness code (18 bits in total). The numeral 52 is a musical note code for a second musical instrument, for instance, a first violin. The numeral 53 is a musical note code for a third musical instrument, for instance, a second violin. The numeral 54 is a fourth musical instrument code, for instance, a cello. The numerals 55, 56, 57 and 58 are musical note codes for first, second, third and fourth musical instruments, respectively. Similarly, four kinds of musical note codes for each musical instruments are arranged in sequence in an EPROM.

Upon insertion of the music card 46 into the synthesizer, and the depression of the keyboard for the desired music title, the designated initial condition area and the character code are read out of the EPROM, and the title of the music is visually indicated, and then, the music is played. The music note code and/or the pause code recorded in the EPROM 15 are provided to the microcomputer 14, and then, forwarded to the synthesizer 46, which generates sound according to the musical interval, the loudness, and the musical note length of each musical note, and actuates the speakers 47 through 50 according to the designated musical instruments. Accordingly, a quartet with four kinds of musical instruments is synthesized with a single music card.

Figure 9:
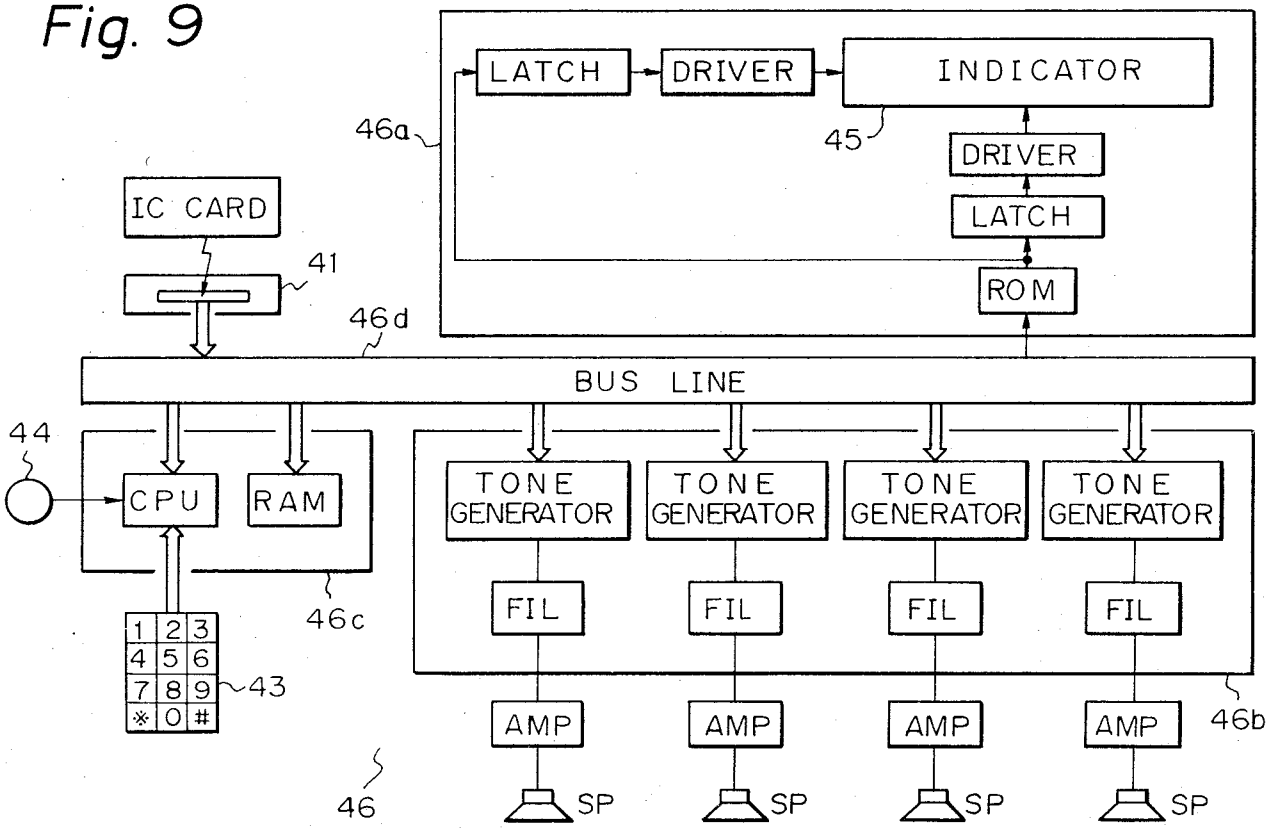
FIG. 9 is a block diagram of the synthesizer according to the present invention.

FIG. 9 is the block diagram of the synthesizer 46, which comprises the indicator unit 46*a*, the synthesizer unit 46*b*, the control unit 46*c*, the bus line 46*d*. The information in the IC music card is applied to the bus line 46*d*, then, applied to the control unit 46*c* which has a micro-computer and its related memory RAM. The switch 44 and the keyboard 43 are also coupled with the control unit 46*c*. The synthesizer unit 46*b* has four sets of tone generators, and filters, for playing quartet. A filter is used for removing unnecessary harmonics in the output of the tone generator. The output of the filter is applied to the related speaker through the related amplifier. The indicator unit 46*a* has a ROM which stores temporarily a signal to be indicated, a pair of latch circuits for holding signals for horizontal and vertical lines, a pair of drivers for actuating an indicator 45 which is implemented by the arrangement of an LED (light emission diode). The bus line 46*d* couples all the units so that the signal is transferred through the bus line between the units.

The configuration of the synthesizer unit 46*b* is conventional. The selection of music by the keyboard 43, and the use of the indicator mounted in the synthesizer are features of the present invention. The control unit 46*c* reads the information of the IC music card, the switch 44 and the keyboard, and stores the information in the RAM. Then, according to the information stored in the RAM, the control unit 46*c* operates the indicator unit 46*a* and the synthesizer unit 46*b* for the music play and the character indication.

As described above in detail, the music card system according to the present invention has the following advantages.

(a) Since a code of a musical note and/or a rest is stored, a small capacity semiconductor memory is enough for reproducing long music.

(b) A card is small in size, and is almost the same size as that of a conventional credit card, and so, the transportation and the operation of a card are easy and simple.

(c) A music title is visually indicated, by storing a character code.

(d) A desired piece of music is selected from a plurality of recorded musical pieces, and the search of the desired music is carried out quickly since the memory is a random access memory, but not a sequential access memory like a conventional magnetic tape medium. Further, a plurality of selected musical pieces may be played successively.

(e) A plurality of musical instruments are played simultaneously, and therefore, a sterophonic sound is obtained.

(f) No recording is necessary at the time of production of a music card, while a conventional disc record must be recorded at the production time. Since a semiconductor memory (EPROM, or EEROM (electrically erasable ROM)) is easy to store a record, an empty card is enough at the production time like a conventional magnetic tape, and after a card is purchased, it can be recorded.

From the foregoing, it will now be apparent that a new and improved music card system has been discovered. It should be understood of course that the embodiments disclosed are merely illustrative and are not intended to limit the scope of the invention. Reference should be made to the appended claims, therefore, rather than the specification as indicating the scope of the invention.

What is claimed is:

1. A music card system comprising:

an integrated circuit card having a plastic support with an integrated circuit memory together with an integrated circuit micro-computer for controlling the reading of said integrated circuit memory, said integrated circuit memory being adapted to store a digital code of music including a music interval, frequency, length, and loudness of each music note, and a length of each music pause, a music synthesizer being adapted to receive said integrated circuit card and then read the digital code on said integrated circuit card during stationary electrical contact therewith, said music synthesizer generating an electrical signal according to a digital code read out of the card, and a speaker for converting said electrical signal to acoustic music sound.

2. A music card system according to claim 1, wherein said integrated circuit memory is adapted further to store a control code designating a music instrument.

3. A music card system according to claim 1, wherein said integrated circuit memory is adapted further to store a character code, and said synthesizer has an indicator which indicates the character code read out of said integrated circuit memory.

4. A music card system according to claim 2, wherein said integrated circuit memory is adapted further to store a character code, and said synthesizer has an indicator which indicates the character code read out of said integrated circuit memory.

5. A music card system according to claim 1, wherein said integrated circuit memory, said synthesizer and said speaker are adapted to play a plurality of channels.

6. A music card system according to claim 2, wherein said integrated circuit memory, said synthesizer and said speaker are adapted to play a plurality of channels.

7. A music card system according to claim 1, wherein size of the music card is approximately 54 mm × 86 mm.

8. A music card system according to claim 1, wherein said integrated circuit memory has stored therein a particular digital code of music including a music interval, frequency, length, and loudness of each note for a particular piece of music.

9. For use in a music card system which includes a music card, a music synthesizer for receiving and reading said card during stationary electrical contact with said card and for generating an electrical signal according to a code stored on said card, and a speaker for converting the electrical signal to acoustic music sound, a music card, comprising:

an integrated circuit card having a plastic support with an integrated circuit memory together with an integrated circuit micro-computer for controlling the reading of said integrated circuit memory, said integrated circuit memory being adapted to store a digital code of music including a music interval, frequency, length, and loudness of each music note, and a length of each music pause.

10. A music card according to claim 9, wherein said integrated circuit memory is adapted further to store a control code designating a music instrument.

* * * * *